United States Patent [19]

Theurer

[11] Patent Number: 4,947,757

[45] Date of Patent: Aug. 14, 1990

[54] METHOD AND MACHINE ARRANGEMENT FOR WORKING IN A TRACK SWITCH SECTION

[75] Inventor: Josef Theurer, Vienna, Austria

[73] Assignee: Franz Plasser Bahnbaumaschinen-Industriegesellschaft m.b.H., Vienna, Austria

[21] Appl. No.: 304,792

[22] Filed: Jan. 31, 1989

[30] Foreign Application Priority Data

Feb. 23, 1988 [AT] Austria ..... 448/88

[51] Int. Cl.[5] ..... E01B 29/17

[52] U.S. Cl. ..... 104/7.2; 104/12

[58] Field of Search ..... 104/2, 7.1, 7.2, 10, 104/12

[56] References Cited

U.S. PATENT DOCUMENTS

| | | | |
|---|---|---|---|
| 3,392,678 | 7/1968 | Plasser et al. | 104/12 |
| 3,744,428 | 7/1973 | Plasser et al. | 104/12 |
| 4,258,627 | 3/1981 | Theurer | 104/12 |
| 4,323,013 | 4/1982 | Theurer | 104/7.2 |
| 4,537,135 | 8/1985 | Theurer | 104/12 |
| 4,572,079 | 2/1986 | Theurer | 104/7.2 |
| 4,625,651 | 12/1986 | Theurer | 104/12 X |
| 4,627,360 | 12/1986 | Theurer et al. | 104/12 X |

FOREIGN PATENT DOCUMENTS 382179 6/1986 Austria .

OTHER PUBLICATIONS

"Railway Track & Structures", 11/80, pp. 48/49.
"Progressive Railroading", 3/4/72, p. 42.

*Primary Examiner*—Andres Kashnikow
*Assistant Examiner*—Virna Lissi Mojica
*Attorney, Agent, or Firm*—Kurt Kelman

[57] ABSTRACT

A method of working a main track and a laterally adjacent track in a track switch section in tandem comprises the steps of intermittently moving a track leveling, lining and tamping machine with lifting tools and vertically and laterally adjustable, vibratory tamping tools along a main track, lifting the main track under the control of a reference system with the lifting tools to a desired level at respective longer ties connecting the tracks, and tamping ballast under the lifted ties with the tamping tools. A switch leveling and tamping machine with lifting tools is moved along the laterally adjacent track and, in the same operating stage, at least one of the rails of the laterally adjacent track is lifted with the lifting tools of the switch leveling and tamping machine, and ballast is tamped under at least a portion of the longer ties at the laterally adjacent track. The ballast tamping is completed under any not previously tamped ties or portions of the longer ties in a subsequent operating stage.

14 Claims, 2 Drawing Sheets

METHOD AND MACHINE ARRANGEMENT FOR WORKING IN A TRACK SWITCH SECTION

BACKGROUND OF THE INVENTION (1) Field of the Invention

The present invention relates to a method of, and a leveling, lining and tamping machine arrangement for, working a track in a track switch section, which comprises the steps of intermittently moving a track leveling, lining and tamping machine with lifting tools and vertically and laterally adjustable, vibratory tamping tools along the track, lifting the main track with the lifting tools to a desired level at respective track ties under the control of a reference system, and tamping ballast under the lifted ties with the tamping tools.

(2) Description of the Prior Art

U.S. Pat. No. 4,572,079, dated Feb. 25, 1986, discloses a mobile track leveling, lining and tamping machine whose track lifting, lining and tamping units are designed specifically for intermittent track working in track switch sections. For this purpose, the vertically adjustable and transversely displaceable tamping unit includes two power-driven pairs of reciprocable and vibratory tamping tools arranged for immersion at the gage and field sides of each rail. This enables the tamping units to be centered even in difficult track sections to tamp ballast under the ties. To enable the track switch, which is very heavy because of the long ties extending between two adjacent tracks in the track switch, to be lifted for proper leveling and lining, the lifting and lining unit has flanged lining rollers and hydraulically operated lifting hooks for engaging each rail, the lifting hooks being vertically and transversely adjustable for engaging rails of complex configuration. Depending on this configuration, the lifting hook may engage the head or the base of the rail.

Such track switch leveling, lining and tamping machines have become ever more important in track maintenance work because the building of track switches is very expensive and their maintenance at the desired position is, therefore, of particular value. These machines are usually equipped with leveling and lining reference systems for control of the lifting and lining tool drives. However, particularly during the lifting of a track switch, the accuracy of the leveling is impaired because of the asymmetrically applied weight of the laterally adjacent track branching off the main track at the track switch and connected thereto by long ties. Therefore, it is necessary to lift the laterally adjacent track additionally and to control its level accurately by means of a proper reference system so that the laterally adjacent tie may be held in its desired position by the subsequent tamping of the lifted ties.

U. S. Pat. No. 4,323,013, dated Apr. 6, 1982, discloses a mobile track leveling, lining and tamping machines for use in tangent track as well as in track switches. The track lifting and lining unit is so constructed that it can move very heavy track switches. It has, per rail, a flanged lining roller, a lifting hook, and two gripping rollers for subtending the rail head at the field side thereof, the flanged lining roller being arranged between the lifting hook and one of the gripping rollers. Holding each rail between the flanged lining roller and two different types of rail gripping elements at the field side enables rails to be lifted simply and securely even in the most difficult switches. At the same time, since the rails are engaged at more points, the impairment of the lifting accuracy due to the branch track is lessened.

U.S. Pat. No. 4,537,135, dated Aug. 27, 1985, discloses a tamping unit for use in tangent track and in track switches. It has four tamping tools per rail and independently operable drives for each tool for pivoting it towards and away from a respective tie. This enables tamping ties with at least one of the tools even in the most difficult portions of the track switch, any tamping tool which would encounter an obstacle during tamping being simply pivoted upwardly away from the tie. On the other hand, the tamping unit can be operated at high efficiency in tangent track with all four tamping tools.

U.S. Pat. No. 4,258,627, dated Mar. 31, 1981, discloses a tamping unit for use in difficult track switches and crossings. The tamping unit associated with each rail is transversely displaceable and has laterally pivotal, reciprocatory and vibratory tamping tools. The lateral pivoting of the tamping tools and the transverse displacement of the unit permits proper centering and immersion of the tamping tools even in difficult track switch sections, any tamping tool encountering an obstacle being pivoted out of its operative position.

Austrian Pat. No. 382,179, published June 15, 1986, also discloses a tamping unit for a mobile tamping machine of particular use in difficult track switches. For this purpose, a two-part tamping tool carrier is vertically movably mounted on a guide column, each tamping tool carrier part being equipped with a pair of tamping tools operating respectively at the field and gage side of the rail. An independently operable vertical adjustment drive for each tamping tool carrier part thus enables the pairs of tamping tools to be independently vertically adjusted for separate operation in case one of the pairs of tamping tools would encounter an obstacle in tamping. For proper centering, the two-part tamping tool carrier is transversely displaceable.

U.S. Pat. No. 3,392,678, dated July 16, 1968, discloses an older type of switch tamper with a machine frame supported on a relatively short wheel base and with a tamping head cantilevered to the machine frame at an end thereof projecting from the front undercarriage, in the operating direction. The tamping head carries an operator's seat and an operating control, and is transversely displaceable. A vertically adjustable track lifting tool is mounted on the underside of the tamping head and is transversely displaceable therewith, together with pairs of reciprocatory and vibratory tamping tools mounted for vertical adjustment on the tamping head. The level of the track is ascertainable by means of a reference system comprising a control signal receiver and transmitter. With this tamping head, it is possible first to tamp the tie at one rail in the track switch and then to tamp the tie at the opposite rail by transversely displacing the tamping head.

An article on pages 48 and 49 of "Railway Track & Structures", November 1980, describes tandem tampers, i.e. two tampers arranged sequentially along a track and operating in tandem one behind the other. The leading tamper may level and tamp every other tie, for example, while the trailing tamper tamps the ties therebetween. This somewhat increases the production in comparison to the use of a single tamper but at the expense of accuracy since, when working in track switches, only every other tie is tamped after being leveled under the control of a reference system on the leading machine while the controlled level is impaired by the trailing machine moving over the level track section.

Finally, page 42 of "Progressive Railroading", March-April 1972, illustrates an automatic production tamper and switch tamper working in tandem. However, the switch sections of a rail worked with these machines cannot be accurately leveled and lined because the relatively heavy laterally adjacent track in the track switch unfavorably influences the lifting with the leading machine and, furthermore, the maintenance of the switch at the desired level is unstable since only every other tie is tamped.

SUMMARY OF THE INVENTION

It is the primary object of this invention to simplify and make more accurate the working of a main track and a laterally adjacent track in a track switch section in tandem, with both tracks of the entire switch being worked more rationally.

According to one aspect of the invention, this and other objects are accomplished with a method of working a main track and a laterally adjacent track in a track switch section in tandem, each track comprising two rails fastened to ties supported on ballast and longer ties connecting the tracks in the track switch section, which comprises the steps of intermittently moving a track leveling, lining and tamping machine with lifting tools and vertically and laterally adjustable, vibratory tamping tools along the main track, lifting the main track with the lifting tools to a desired level at respective ones of the longer ties under the control of a reference system, and tamping ballast under the lifted ties with the tamping tools. A switch leveling and tamping machine with lifting tools is moved along the laterally adjacent track and, in the same operating stage, at least one of the rails of the laterally adjacent track is lifted with the lifting tools of the switch leveling and tamping machine, and ballast is tamped under at least a portion of the longer ties at the laterally adjacent track. The ballast tamping is completed under any not previously tamped ties or portions of the longer ties in a subsequent operating stage.

According to another aspect of the present invention, a mobile switch leveling, lining and tamping machine arrangement for the tandem working of a main track and a laterally adjacent track in a track switch section comprises two switch leveling, lining and tamping machines respectively intermittently movable along the main track and the laterally adjacent track in an operating direction for working in tandem in the track switch section. Each machine comprises a machine frame supported on the track by two longitudinally spaced undercarriages, lifting and lining tools arranged to engage at least one of the track rails, drive means for vertically and laterally adjusting the lifting and lining tools on the machine frame, a leveling and lining reference system, a control responsive to the reference system for operating the drive means and thereby to adjust the lifting and lining tools vertically and laterally, and a vertically and transversely adjustable switch tamping tool head comprising pairs of vibratory tamping tools reciprocable in a direction extending parallel to the track and pivotal in a direction transverse thereto. Means is provided for connecting the controls of the two machines whereby the drive means of the lifting and lining tools on the machines are operated in tandem.

The working method of this invention for the first time makes it possible in a surprisingly simple manner to level a track switch accurately and to provide a long-lasting tamped support for the track at this accurate level, merely by operating two machines in tandem side-by-side and lifting and, if desired, lining as well as tamping the long connecting ties together in the very heavy track switch section which is difficult to lift. Particularly in the range of the very long and correspondingly heavy track ties in the switch, the two side-by-side operating machines may lift the track switch section over the entire tie length to the desired level. The immediately following and almost simultaneous tamping with the tamping units of the side-by-side operating machines will assure a long-lasting support for the evenly leveled main track and laterally adjacent track. The ballast tamping can then be completed under any not previously tamped longer ties or portions thereof, for example at the beginning of the track switch section or between the main track and the laterally adjacent track, in a subsequent operating stage with one of the machines, optionally under a repeated level control. Since an opposite end of the tie is already in the desired position, this requires only a simple holding of the track at this position before the subsequent tamping proceeds. Another advantage of this working method resides in the fact that it requires no special work or retrofitting on the machines. The method also subjects the machines to less wear and enhances the efficiency of the operation.

The machine arrangement of the invention connects the two machines into an operating unit while requiring relatively simple means for connecting the machine controls, such as electrical conductor lines between the controls and/or radio signal transceivers. The connection between the controls of the two machines enables all operations, including the propelling drives for the two machines, if desired, to be fully synchronized for working simultaneously and advancing in unison. While the machines may thus operate as a unit, they may also be operated independently of each other so that the machines on the main track and the laterally adjacent track may be operated automatically or semi-automatically for rapid operation of the various tools and their centering over a common tie to be leveled and tamped. The arrangement not only permits a track switch to be leveled and tamped very accurately but also operates at a substantially higher efficiency, particularly with respect to the lifting of even the heaviest track switches including, for example, concrete ties.

BRIEF DESCRIPTION OF THE DRAWING

The above and other objects, advantages and features of the present invention will become more apparent from the following detailed description of certain now preferred embodiments thereof, taken in conjunction with the accompanying, somewhat schematic drawing wherein.

DETAILED DESCRIPTION OF PREFERRED EMBODIMENTS

Figure 1:
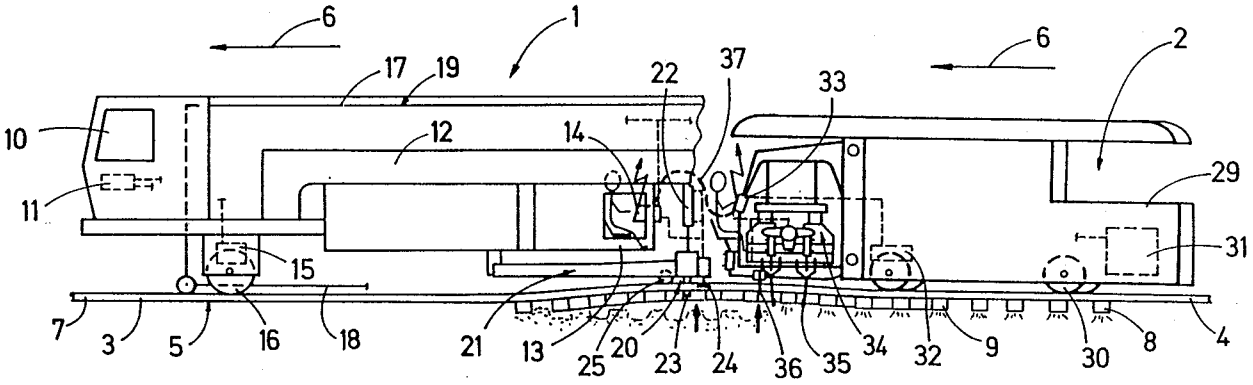
FIG. 1 is a side elevational view of a mobile switch leveling, lining and tamping machine arrangement for the tandem working of a main track and a laterally adjacent track in a track switch section, with two switch leveling, lining and tamping machines movable side-by-side along the main track and the laterally adjacent track, the controls of the two machines and their operating personnel being connectable to, and in contact with, each other.
Figure 2:
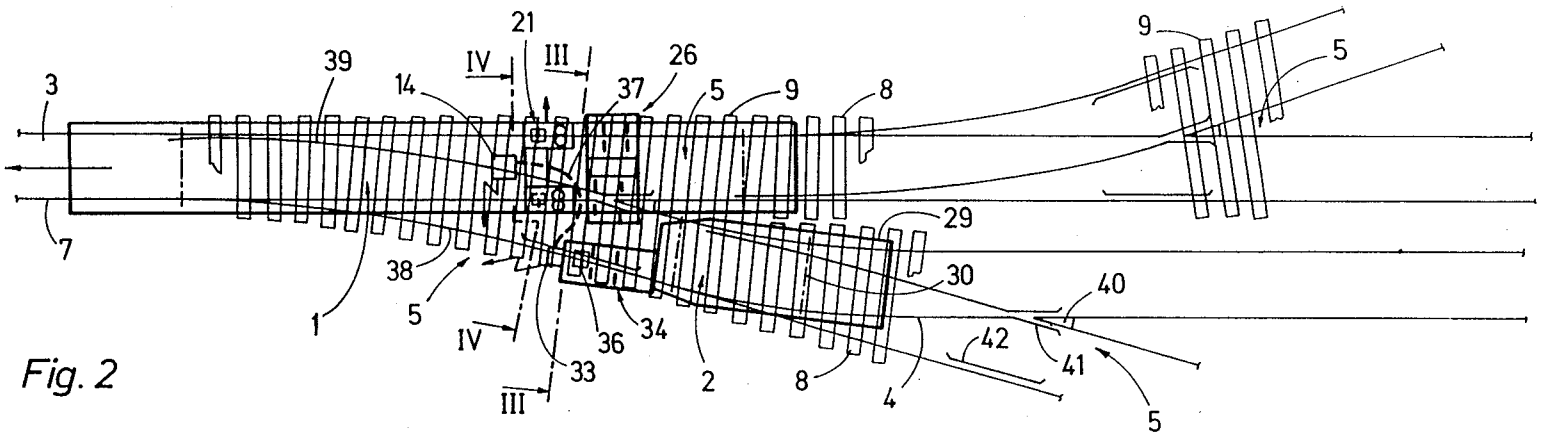
FIG. 2 is a smaller top view of the two side-by-side operating machines of FIG. 1 in the track switch section.

Referring now to the drawing and first to FIGS. 1 and 2, there is shown a mobile switch leveling, lining and tamping machine arrangement for the tandem working of main track 3 and laterally adjacent track 4 branching off the main track in track switch section 5, which comprises leading switch leveling, lining and tamping machine 1 and trailing switch leveling, lining and tamping machine 2. Each track comprises two rails 7 fastened to standard ties 8 and longer ties 9 connecting the tracks in the track switch section. Machines 1 and 2 are respectively intermittently movable in an operating direction along main track 3 and laterally adjacent track for working side-by-side and in tandem in track switch section 5.

Leading machine 1 is longer than trailing machine 2 and comprises machine frame 12 supported on two longitudinally spaced undercarriages 16 providing a relatively long wheel base. Propelling drive 15 is connected to one of the undercarriages to move the machine along the track, driving cabs 10 being mounted at each end on the machine frame. Lifting and lining tools 20, 25 are arranged to engage at least one of the track rails 7 and drive means 22 vertically and laterally adjust the lifting and lining tools on machine frame 12. In the illustrated embodiment, lifting and lining unit 21 incorporates lifting tools 20 and lining tools 25, the lifting tools for engaging and lifting rails 7 being transversely and vertically adjustable lifting and lining hooks 23 as well as pairs of gripping rollers 24 subtending the rail head at the field side and gage side of rail 7, and the lining tools being flanged rollers 25 which support unit 21 on track rails 7 for movement therealong. Drive means 22 are hydraulic drives vertically and laterally adjustably mounting the unit on machine frame 12. The machine also comprises leveling and lining reference system 19 including a leveling reference wire 17 and lining reference wire 18. Operator's cab 13 is mounted on machine frame 12 within view of track lifting and lining unit 21 and is equipped with control 14 responsive to reference system 19 for operating drive means 22 and thereby to adjusting the lifting and lining tools vertically and laterally.

Figure 3:
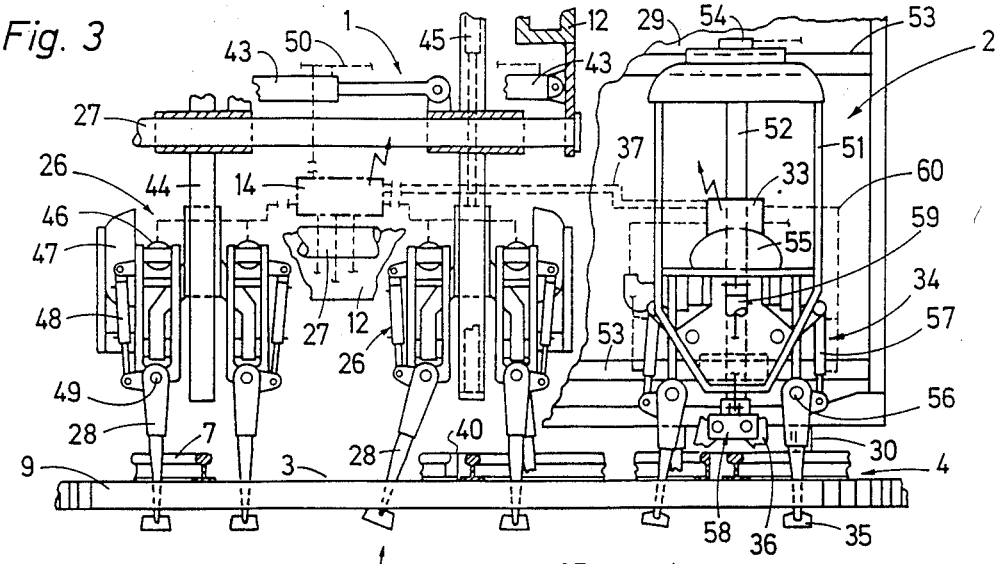
FIG. 3 is an enlarged fragmentary end view of the lower part of the two machines and showing the tamping units, taken along line III—III of FIG. 2.

The machine further comprises vertically and transversely adjustable switch tamping tool head 26 (visible in FIG. 2 but covered by the forward portion of trailing machine 2 in FIG. 1 position). As is shown in FIG. 3 and will be described in detail hereinafter, tamping tool head 26 comprises pairs of vibratory tamping tools 28 reciprocable in a direction extending parallel to the track and pivotal in a direction transverse thereto.

Trailing and smaller switch leveling, lining and tamping machine 2 is movable in operating direction 6 along branch track 4 and comprises machine frame 29 supported on the branch track by two longitudinally spaced undercarriages 30 providing a short wheel base. Propelling drive 32 is connected to one of the undercarriages to move the machine along the track and receives its power from power plant 31. Lifting and lining tools 36 are arranged to engage at least one of the track rails 7 of branch track 4 and drive means vertically and laterally adjust the lifting and lining tools on machine frame 29. In the illustrated embodiment, the lifting and lining tools are incorporated in a vertically and transversely adjustable switch tamping tool head 34 cantilevered to machine frame 29 at an end thereof projecting from front undercarriage 30, in the operating direction, the tamping head also carrying an operator's seat and control 33, as well as pairs of tamping tools 35 reciprocable in a direction extending parallel to the track and pivotal in a direction transverse thereto. Such a forwardly projecting tamping head has the particular advantage of enabling an outer rail of a branch track to be tamped in an area closer to the point of intersection of the switch rails, where the inner rail already crosses the main track.

Controls 14 and 33 of machines 1 and 2 transmit electrical control signals responsive to reference system 19 for operating the drive means for the operating tools of the machines, and the controls are connected by electrical conductor lines 37 for controlling the operating tools of the two machines in unison or independently of each other. As is schematically indicated in FIGS. 1 and 2, the two controls may also be connected by radio signal transmitting and receiving means for the control signals.

FIG. 2 diagrammatically illustrates a typical railroad station track with two track switch sections 5 wherein laterally adjacent tracks 4 branch off main track 3. Depending on the operating direction, it would also be possible to designate branch tracks 4 as main tracks and main track 3 as a track laterally adjacent thereto. While the tracks outside the switches have standard ties 8, longer ties 9 having a length of about 5 m connect tracks 3 and 4 in track switch sections 5. Tamping tool heads 26 and 34 of the machines 1 and 2 are centered with the pairs of tamping tools straddling a respective longer tie 9. Lifting and lining hooks 23, lifting rollers 24 and flanged lining rollers 25 of lifting and lining unit 21 of machine 1 are in engagement with rails 7 of main track 3 and the track is lifted to a desired level (and lined, if desired) under the control of reference system 19. At the same time, rail 38 of branch track 4 remote from main track 3 is lifted to the same level by lifting tool 36 on machine 2. In addition to this outer rail 38, switch 5 comprises transversely displaceable switch tongue 39, frog 40, guard rail 41 opposite thereto and guide rail 42 all of which constitute obstacles to the immersion of the tamping tools in the ballast and/or to the engagement of the rails by the lifting and lining tools so that it is necessary to move these tools vertically and/or laterally out of the way of these obstacles when the machines operate thereat.

FIG. 3 shows tamping heads 26 and 34 in detail. Switch tamping heads 26 of machine 1 are transversely displaceably mounted on transverse guide beam 27 affixed to machine frame 12 and are linked to hydraulic drives 43 for transverse displacement. In this way, tamping heads 26 may also be centered over switch tongues and the like. Each tamping head 26 is vertically adjustably mounted on carrier frame 44, and hydraulic drive 45 serves to adjust the tamping head vertically. Tamping tools 28 are reciprocable by drives 46 and are vibrated by vibrating drive means 47. Two reciprocating vibratory tamping tools are provided at the field side and the gage side of the rail, and each tool 28 has its own independent drive 48 for independently pivoting each tool laterally about axis 49 extending in the direction of the rail. In this way, any tool which may encounter an obstacle, such as switch tongue 39, guard rail 41 or the like, upon lowering of the tamping head can be pivoted out of the way. All the drives 43, 45, 46, 47, 48 are connected by control lines 50 to control 14.

Figure 4:
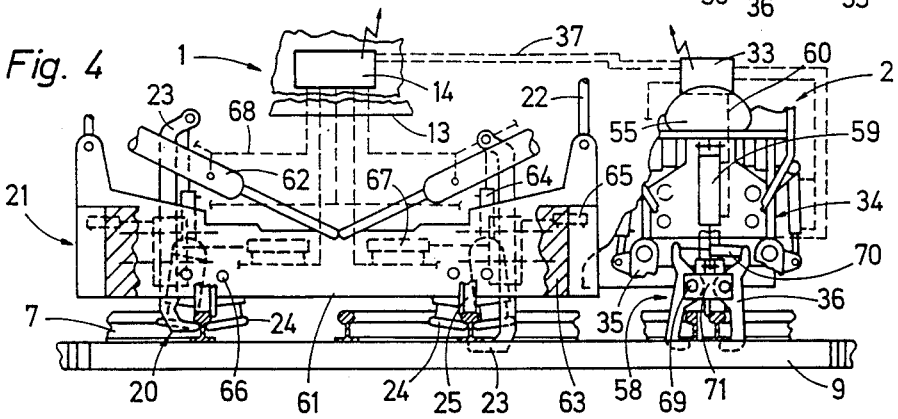
FIG. 4 is an enlarged fragmentary end view of the lower part of the two machines and showing the lifting and lining units, taken along section line IV—IV of FIG. 2.

Switch tamping head 34 cantilevered to the front end of machine frame 29 of machine 2 is vertically adjustably mounted on guide columns 52 of carrier frame 51. The carrier frame is transversely displaceably mounted on transverse guide beam 53 affixed to the front end of machine frame 29. The transverse displacement of carrier frame 51 may be effected by hydraulic drive 54 operating a pinion engaging a rack extending along transverse guide beam 53. Each tamping tool 35 has its own independent drive 57 for independently pivoting each tool laterally about axis 56 extending in the direction of the rail. Operator's seat 55 is mounted on the free end of forwardly projecting tamping head 34 and lifting hooks 36 of track lifting unit 58 are vertically adjustable by hydraulic drive 59 connecting the track lifting unit to carrier frame 51. Drives 54, 57, 59 are connected by control lines 60 to control 33 mounted on carrier frame 51. Relatively long and rapidly detachable and connectable electrical conductor lines 37 interconnect controls 14 and 33 of machines 1 and 2. Radio signal transmitting and receiving means are associated with the controls within reach of the operators at the respective controls Respective track lifting and lining units 21 on machine 1 and 58 on machine 2 are illustrated in detail in FIG. 4. Unit 21 comprises carrier frame 61 supporting rail-engaging lifting hooks 23 and flanged gripping rollers 23 as well as flanged lining rollers 25 which support the carrier frame on the rails. Lifting drives 22 and lining drives 62 link carrier frame 61 of the track lifting and lining unit to machine frame 12 of machine 1. The carrier frame has an elongated carrier frame 63 longitudinally adjustably connected to the machine frame. Drives 64, 65 are linked to hooks 23 for vertically and laterally adjusting the same for selective engagement of the base or the head of the rail and clamping the rail. Pairs of cooperating gripping rollers 24 are pivotal by drive 67 about axis 66 extending in the direction of the rail for subtending the rail head and clamping the rail between the pair of gripping rollers. When an obstacle is encountered, a respective gripping roller 24 may be pivoted out of the way while the other gripping rollers may remain in clamping engagement with rail 7. Control lines 68 connect drives 22, 62, 64, 65 and 67 of lifting and lining unit 21 to control 14 of machine 1, which also includes radio transmission means, as schematically indicated in FIGS. 3 and 4.

Lifting hooks 36 of track lifting and lining unit 58 on machine 2 are arranged like pivotal tongs and may be pivoted about axes 69 extending in the direction of the rail by drive 70 which connects the upper ends of the lifting hooks. The lifting hooks are mounted on elongated carrier frame 71 extending in the direction of the rail and whose rear end is pivoted to carrier frame 51 of tamping head 34 about an axis extending transversely to the direction of the rail while its opposite end reaches under operator's seat 55 and is connected to drive 59 for vertical adjustment. Elongated carrier frame 71 of track lifting and lining unit 58 is also transversely displaceably mounted so that lining forces exerted by lining drives 62 on machine 1 may be transmitted to track lifting and lining unit 58 on machine 2. Control lines 60 connect drives 59 and 70 of unit 58 to control 33 which, in turn, is connected to control 14 by line 37.

The method of working main track 3 and laterally adjacent track 4 in track switch section 5 in tandem by machines 1 and 2 illustrated in FIGS. 1 to 4 will partly be obvious from the above description of their structure and will now be described in detail.

Track leveling, lining and tamping machine 1 with lifting tools 23, 24 and vertically and laterally adjustable, vibratory tamping tools 28 is moved intermittently along main track 3 in an operating direction indicated by arrow 6. As it approaches track switch section 5 formed by the main track and branch track 4, each standard tie 8 of main track 3 is leveled and/or lined by track lifting and lining unit 21 and each leveled and/or lined tie is tamped at the desired level by switch tamping heads 26 associated with each rail 7 of the main track. Control 14 in operator's cab 13 controls the track positioning in response to control signals from reference system 19 and also the tamping operation of ballast under the lifted ties with the tamping tools. At the same time, switch leveling, lining and tamping machine 2 with lifting tools 36 is moved along laterally adjacent track 4 in operating direction 6 until forwardly projecting tamping head 34 is centered over outer rail 38 of branch track 4 at the first longer tie 9 common to both tracks in track switch section 5. After the two tamping heads 26 on machine 1 are also centered over this tie 9, outer rail 38 of laterally adjacent track 4 is lifted with lifting tools 36 of machine 2 and ballast is tamped under this longer tie 9 by tamping tools 35 along a portion thereof, in the same operating stage. For this purpose, controls 14 and 33 are connected by flexible electrical conductor line 37 or, instead of this connection or in addition thereto, a radio connection is established between the controls equipped with radio signal transmitting and receiving means. The two machines operate side-by-side in the same operating stage as they intermittently move to successive longer ties 9 in switch 5, the operating drives on both machines being operated by control 14 in cab 13 of machine 1, which is operatively connected to control 33 of machine 2. The tandem operation is initiated by positioning track switch section 5 at a desired position determined by reference system 19 and holding the switch at this position while the work continues during the intermittent advance of the machines along the switch in operating direction 6. For this purpose, lifting and lining hooks 23 and gripping rollers 24 of machine 1 are in engagement with rails 7 of main track 3 while lifting hooks 36 of machine 2 are engaged with outer rail 38 of branch track 4. The subsequent actuation of lifting drives 22 and 59 and, if required, lining drives 62 is effectuated in common by controls 14, 33 so that the long and heavy ties 9 are substantially uniformly repositioned over their entire length under the control of references system 19. After tamping heads 26 of machine 1 and tamping head 34 of machine 2 are lowered for immersion of the tamping tools in the ballast, each long tie 9 is tamped under the main track as well as the branch track. After hooks 23 and 36 are disengaged from the respective rails of the tracks, propelling drives 15 and 32 of machines 1 and 2 are actuated for the successive intermittent forward movements of the machines in operating direction 6. As soon as tamping heads 26, 34 of machines 1 and 2 are centered over the next long tie 9, the above-described operation is repeated there.

This tandem operation of the two machines advancing side-by-side for the simultaneous leveling and/or lining and tamping of track switch section 5 is continued until machine 2 can no longer advance on branch track 4 because of lack of space. The tamping of this last long tie 9 in the switch by the two machines is illustrated in FIG. 2. Subsequent to this operating stage, machine 2 remains in position with raised lifting hooks 36 while machine 1 is moved forwardly in operating direction 6 to the next long tie 9 During this forward movement of machine 1, lifting hooks 23 and gripping rollers 24 of machine 1 and lifting hooks 36 of machine 2 may remain respectively actuated by control 14 and control 33 connected to control 14 by control line 37. Since the lifting of outer rail 38 by lifting hooks 36 of machine 2 has a forwardly directed lifting force component in the operating direction, the somewhat shorter long tie 9 at the crossing point between the main and branch tracks is also leveled and/or lined by the common application of lifting and lining units 21 and 58 of machines 1 and 2 although unit 21 precedes unit 58 at this point. After longer ties 9 have been tamped by tamping heads 26, the ballast tamping under any not previously tamped tie or portions thereof at outer rail 38 of the branch track is completed by a tamping head 26 of machine 1 or tamping head 34 of machine 2 in a subsequent operating stage in which the respective machine is moved through the switch, preferably while the track is lifted again.

In a preferred embodiment of this switch working method, the leveling and/or lining of at least one or the other rails 38, 7 of branch track 4 or a laterally adjacent parallel track by hooks 36 of machine 2 in tandem with that of main track 3 is effected at least over a portion of switch 5 by control 14 whose control signals are transmitted to control 33 and which is responsive to reference system 19, and these controls also actuate the intermittent forward movement of the machines and/or the tamping of long ties 9 in the same operating stage. The common control of the track positioning and tamping by a single control on one of the machines enables the individual actuation of all operating tools to be effected substantially simultaneously and in synchronization. The connection between the controls on the two machines assures that the repositioning of even long and heavy ties, as well as the intermittent forward movement of the machines, proceeds simply, without trouble and substantially simultaneously to provide a very accurate leveling and/or lining of the track switch section. This produces not only an accurate level and/or line but also is highly efficient.

In the preferred illustrated embodiment, only rail 38 of laterally adjacent track 4 remote from main track 3 is lifted and/or lined with the main track in the same operating stage, and ballast is tamped only under the portions of longer tie 9 at remote rail 38 in this operating stage. In this embodiment, laterally adjacent track 4 is at least locally held by hooks 36 at the desired level while switch leveling and tamping machine 2 is held stationary at final long tie 9 of the switch and ballast is tamped under this long tie or portions thereof to maintain the laterally adjacent track at the desired level. In this manner, the switch is engaged at one location at three points by lifting tools, which assures a rapid, accurate and more effective leveling operation. Both rails of the main track are engaged by the lifting tools of machine 1 and one of the rails of the branch track is engaged by the lifting hooks of machine 2. The tie is tamped at three locations to solidify the leveled position. Because the flexing line of the lifted outer rail extends forwardly, the tie ends fastened to the outer rail may also be lifted in a track section ahead of the second machine. This has the advantage that the shorter ties 8, which for space reasons cannot be lifted by the second machine in tandem with the first machine, are lifted by the first machine. These ties, which in this manner have been raised to the desired level at both tie ends and have been tamped by the first machine along the main track, may then be tamped also in the range of the outer rail in a subsequent operating stage.

Figure 5:
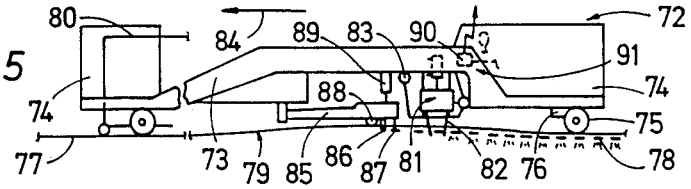
FIG. 5 is a highly schematized side elevational view of another embodiment of a machine arrangement according to the invention, with a track leveling, lining and tamping machine arranged for substantially simultaneous operation in a switch with a like machine arranged laterally thereof and behind it, the controls of the two machines and their operating personnel being connectable to, and in contact with, each other.
Figure 6:
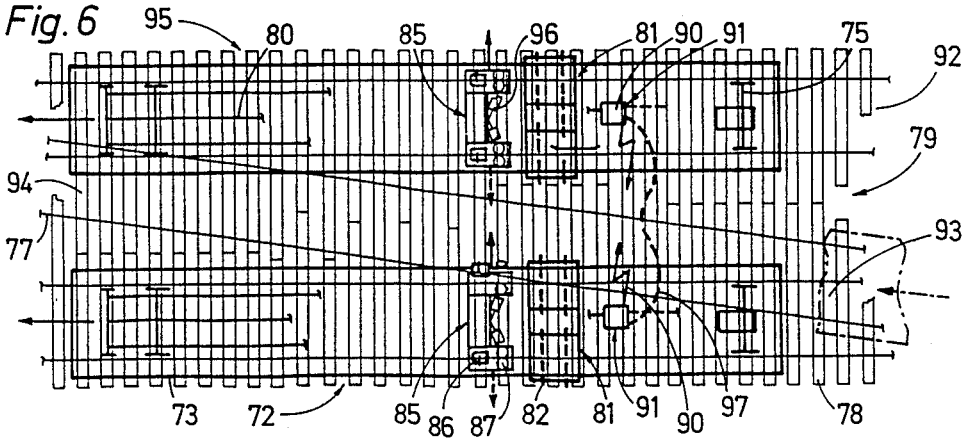
FIG. 6 is an enlarged top view showing the two machines of FIG. 5 operating on two laterally adjacent and parallel tracks along a switch extending between the two tracks.

FIG. 5 schematically illustrates a particularly advantageous type of mobile switch leveling, lining and tamping machine 72 useful in an arrangement for the tandem working of two parallel tracks 92, 93 and branch track 94 connecting the parallel tracks in switch section 79, as shown in FIG. 6. Each track comprises two rails 77 fastened to ties supported on ballast and longer ties 78 in the track switch section connecting the tracks. The machine is intermittently movable in an operating direction indicated by arrow 84 along main track 93 by drive 76 and comprises elongated machine frame 73 supported on the track by two longitudinally spaced undercarriages 75. Leveling and/or lining errors are monitored by leveling and lining reference system 80 mounted on the machine frame. The machine frame also carries vertically and transversely adjustable switch tamping tool head 81 comprising pairs of vibratory tamping tools 82 reciprocable in a direction extending parallel to the track and pivotal in a direction transverse thereto, as more fully described hereinabove in connection with tamping head 26. Tamping tool head 81 is mounted on transverse guide 83 for transverse adjustment. Track lifting and lining tool unit 85 is mounted on the machine frame ahead of the tamping head, in the operating direction, and comprises lifting and lining tool hooks 86, lifting tool rollers 87 and flanged lining tool rollers 88 arranged to engage at least one of the track rails 77. Drive means 89 link unit 85 to the machine frame for vertically and laterally adjusting the lifting and lining tools on the machine frame. The track lifting and lining unit also is substantially of the same structure as described hereinabove in connection with unit 21. A respective operator's cab 74 is mounted on each end of machine frame 73 and the rear cab has control 91 responsive to the reference system for operating drive means 89 and thereby to adjust the lifting and lining tools vertically and laterally. Control 91 has a radio transceiver 90.

As shown in FIG. 6, switch leveling, lining and tamping machine 95 of substantially the same structure as machine 72 runs on laterally adjacent track 92 in transverse alignment with machine 72. While lifting and lining tools 86, 87, 88 of track lifting and lining units 85 of machines 72 and 95 engage both rails 77 of parallel tracks 92, 93 and level and/or line the same by operation of drive means 96, the four tamping tools 82 of tamping heads 81 at each side of rails 77 of tracks 92, 93 are centered over a respective long tie 78, which may be a heavy concrete tie, connecting the parallel tracks in switch section 79. The tamping heads of the illustrated switch leveling, lining and tamping machines can be used in tangent track and in switches. They have eight independently vertically and laterally adjustable tamping tools 82, each equipped with its own adjustment drive for pivoting the tool laterally in the direction of elongation of the tie. Controls 91 of machines 72 and 95 are connected by flexible electrical conductor line 97 whereby drive means 96 of the lifting and lining tools of the two machines are operated in tandem. In this manner and with the relatively inexpensive addition of connecting means between the controls of two otherwise conventional machines, the two machines may be operated and, if desired, moved in tandem for a uniform operation of the machines in a track switch section. On the other hand, while the two machines operate substantially as a unit in a switch, they may be operated totally independently from each other, when and where desired, and the operating tools may be centered at each track over a common connecting tie. This tandem arrangement provides not only a more accurate track positioning in track switch sections but also considerable increases the operating efficiency, particularly with respect to the lifting even of the heaviest track sections, as compared to the operation of a single machine.

The operation of machines 72, 95 in switch section 79 will now be described in detail:

When twin switch leveling, lining and tamping machines 72, 95 running on parallel tracks 93, 92 reach track switch section 79, controls 91 of the two machines are connected by line 97 and through radio transceivers 90 so that the drive means of both machines may be controlled from cab 74 of one of the machines. The two machines advance through the switch side-by-side since their forward drives 76 are also commonly controlled, and the track lifting and lining units 85 as well as tamping heads 81 operate in tandem. In this way, the tracks of the very heavy switch section 79 are leveled and tamped at each long tie 78 substantially simultaneously. After the two machines move intermittently from long tie 78 to long tie 78 in the switch section to level and tamp the two parallel tracks, branch track 94 connecting the two parallel tracks in the switch section is leveled and tamped in a subsequent operation by one of the machines 72, 95, which can be done very simply and rapidly because the parallel tracks are already in their desired position.

If desired, machines 72 and 95 need not work in side-by-side alignment in track switch section 79 but one of the machines may be ahead of the other machine by a few ties 78. In this case, too, long connecting ties 78 between the two parallel tracks will assure the desirable tandem lifting and tamping of the two tracks.

The described tandem operation of two machines in a track switch section makes it possible to use a variety of different conventional track leveling, lining and tamping machines with various tamping heads and/or track lifting and lining units. For example, it is possible to combine a switch tamper such as disclosed in U.S. Pat. Nos. 4,572,079 and 4,258,627 with a universal tamper such as illustrated in FIG. 6 and carrying switch tamping heads such as disclosed in U.S. Pat. Nos. 4,537,135 and 4,323,013 for the tandem working of a switch section. If desired, the tamping heads may have two-part tamping tool carriers, as disclosed in Austrian Pat. No. 382,179, for working in particularly difficult track sections. It is also possible to use two tampers as disclosed in U. S. Pat. No. 3,392,678, for example, with two or three tamping heads cantilevered to the front end of the machine frames.

What is claimed is:

1. A method of working a main track and a laterally adjacent track in a track switch section in tandem, each track comprising two rails fastened to ties supported on ballast and longer ties connecting the tracks in the track switch section, which comprises the steps of (a) intermittently moving a track leveling, lining and tamping machine with lifting tools and vertically and laterally adjustable, vibratory tamping tools along the main track, (b) lifting the main track with the lifting tools to a desired level at respective ones of the longer ties under the control of a reference system, (c) tamping ballast under the lifted ties with the tamping tools, (d) moving a switch leveling and tamping machine with lifting tools along the laterally adjacent track and, in the same operating stage, (1) lifting at least one of the rails of the laterally adjacent track with the lifting tools of the switch leveling and tamping machine, and (2) tamping ballast under at least a portion of the longer ties at the laterally adjacent track, and (e) completing the ballast tamping under any not previously tamped ties or portions of the longer ties in a subsequent operating stage, the two machines being simultaneously operated under control of a common electrical control.

2. The track working method of claim 1, wherein the ballast tamping is completed after the entire track switch section has been worked in steps (a) to (d).

3. The track working method of claim 1, wherein at least one of the rails of the laterally adjacent track is again lifted with the lifting tools of the switch leveling and tamping machine before the ballast tamping is completed at the ties or portions thereof not previously tamped.

4. The track working method of claim 1, wherein the laterally adjacent track branches off the main track in the track switch section.

5. The track working method of claim 1, wherein the laterally adjacent track extends parallel to the main track in the track switch section.

6. The track working method of claim 1, wherein the laterally adjacent track is at least locally held at the desired level while the switch leveling and tamping machine is held stationary, and ballast is tamped under at least one of the longer ties or portions thereof in the track switch section to maintain the laterally adjacent track at the desired level.

7. The track working method of claim 1, wherein only the rail of the laterally adjacent track remote from the main track is lifted with the main track in the same operating stage, and ballast is tamped only under the portions of at least one of the longer ties at the remote rail in the same operating stage.

8. A mobile switch leveling, lining and tamping machine arrangement for the tandem working of a main track and a laterally adjacent track in a track switch section, each track comprising two rails fastened to ties supported on ballast and longer ties connecting the tracks in the track switch section, which comprises (a) two switch leveling, lining and tamping machines respectively intermittently and simultaneously movable along the main track and the laterally adjacent track in an operating direction for working in tandem in the track switch section, each machine comprising (1) a machine frame supported on the track by two longitudinally spaced undercarriages, (2) lifting and lining tools arranged to engage at least one of the track rails, (3) drive means for vertically and laterally adjusting the lifting and lining tools on the machine frame, (4) a control for operating the drive means and thereby to adjust the lifting and lining tools vertically and laterally, and (5) a vertically and transversely adjustable switch tamping tool head comprising pairs of vibratory tamping tools reciprocable in a direction extending parallel to the track and pivotal in a direction transverse thereto, (b) a leveling and lining reference system on at least one of the machines, the control on said one machine transmitting electrical control signals responsive to the system, and (c) a common electrical control means connecting the controls of the two machines for simultaneous operation whereby the drive means of the lifting and lining tools on the machines are operated in tandem.

9. The mobile switch leveling, lining and tamping machine of claim 8, wherein the lifting and lining tools on the machine movable along the laterally adjacent track are transversely adjustable with the tamping tool head.

10. The mobile switch leveling, lining and tamping machine of claim 9, wherein said tamping tool head is cantilevered to the machine frame at an end thereof projecting from a front one of the undercarriages, in the operating direction, the tamping tool head carries an operator'seat and the control, and further comprising drives for transversely displacing and vertically adjusting the tamping tool head.

11. The mobile switch leveling, lining and tamping machine arrangement of claim 8, wherein the two machines are substantially of the same structure.

12. The mobile switch leveling, lining and tamping machine arrangement of claim 8, wherein the control on one of the machines transmits electrical control signals responsive to the reference system for operating the drive means, and the common electrical control means connecting the controls of the two machines are electrical conductor lines between the controls.

13. The mobile switch leveling, lining and tamping machine arrangement of claim 8, wherein the common electrical control means for connecting the controls of the two machines are radio signal transceivers.

14. The mobile switch leveling, lining and tamping machine arrangement of claim 8, wherein the tamping tools are independently vertically and laterally adjustable.

* * * * *